US009711867B2

(12) United States Patent
Jecko et al.

(10) Patent No.: US 9,711,867 B2
(45) Date of Patent: Jul. 18, 2017

(54) BASIC ANTENNA, AND CORRESPONDING ONE- OR TWO-DIMENSIONAL ARRAY ANTENNA

(71) Applicants: Bernard Jecko, Rilhac Rancon (FR); Mohammad Hajj, Limoges (FR); Regis Chantalat, Naves (FR); Moustapha Salah Toubet, Limoges (FR)

(72) Inventors: Bernard Jecko, Rilhac Rancon (FR); Mohammad Hajj, Limoges (FR); Regis Chantalat, Naves (FR); Moustapha Salah Toubet, Limoges (FR)

(73) Assignees: CENTRE NATIONAL DE LA RECHERCHE SCIENTIFIQUE (C.N.R.S), Paris (FR); UNIVERSITE DE LIMOGES, Limoges (FR)

( * ) Notice: Subject to any disclaimer, the term of this patent is extended or adjusted under 35 U.S.C. 154(b) by 286 days.

(21) Appl. No.: 14/366,474

(22) PCT Filed: Dec. 20, 2012

(86) PCT No.: PCT/EP2012/076509
§ 371 (c)(1),
(2) Date: Jun. 18, 2014

(87) PCT Pub. No.: WO2013/092928
PCT Pub. Date: Jun. 27, 2013

(65) Prior Publication Data

US 2015/0015449 A1 Jan. 15, 2015

(30) Foreign Application Priority Data

Dec. 21, 2011 (FR) ..... 11 62141

(51) Int. Cl.
*H01Q 19/185* (2006.01)
*H01Q 19/10* (2006.01)
(Continued)

(52) U.S. Cl.
CPC ..... *H01Q 19/185* (2013.01); *H01Q 1/523* (2013.01); *H01Q 15/006* (2013.01); *H01Q 19/10* (2013.01); *H01Q 21/065* (2013.01); *H01Q 25/00* (2013.01)

(58) Field of Classification Search
CPC ..... H01Q 19/185; H01Q 15/006; H01Q 1/523
See application file for complete search history.

(56) References Cited

U.S. PATENT DOCUMENTS 6,549,172 B1 4/2003 Thevenot et al.
2010/0321261 A1* 12/2010 Thevenot ..... H01P 1/2005 343/731

FOREIGN PATENT DOCUMENTS

EP 1406348 A2 4/2004
WO 0137373 A1 5/2001
WO 2011031499 A2 3/2011

OTHER PUBLICATIONS

Antenna Theory: A Review, Balanis, Proc. IEEE vol. 80 No. 1 Jan. 1992.*

(Continued)

*Primary Examiner* — Robert Karacsony
*Assistant Examiner* — Amal Patel
(74) *Attorney, Agent, or Firm* — Young & Thompson

(57) ABSTRACT

A basic antenna (2), designed to form a radiating element of an array antenna, includes, superimposed, a planar reflector (4), a probe (6), and an assembly (8) of the EBG type by default in the form of a cavity (16). The basic antenna (2) includes a wall enclosure (10) capable of reflecting the electromagnetic waves at the operating frequency or fre- (Continued)

quencies of the basic antenna (2), the wall enclosure (10) being an extension in a direction orthogonal to the planar reflector (4) and simultaneously surrounding only the probe (6), the cavity (16) and the structure (14).

The one- or two-dimensional array antenna includes a plurality of joined basic antennas (2) arranged compactly.

18 Claims, 9 Drawing Sheets

(51) Int. Cl.

| | |
|---|---|
| ***H01Q 25/00*** | (2006.01) |
| ***H01Q 21/06*** | (2006.01) |
| ***H01Q 1/52*** | (2006.01) |
| ***H01Q 15/00*** | (2006.01) |

(56) References Cited

OTHER PUBLICATIONS

M. Hajj, T. Monédière, B. Jecko and R. Chantalat, "A novel directivity/beam reconfigurable M-EBG antenna," 2010 IEEE Antennas and Propagation Society International Symposium, Toronto, ON, 2010, pp. 1-4.*

Hajj et al., "A Novel Directivity/Beam Reconfigurable M-EBG Antenna", IEEE Antennas and Propagation Society International Symposium, 2010, pp. 1-4, XP032145900.

Serhal et al., "Multifed Sectoral EBG Antenna for WiMAX Applications", IEEE Antennas and Wireless Propagation Letters, 2009, vol. 8, pp. 620-623.

Weily et al., "A Planar Resonator Antenna Based on a Woodpile EBG Material", IEEE Transactions on Antennas and Propagation, 2005, vol. 53, No. 1, pp. 216-223.

International Search Report, dated May 3, 2013, from corresponding PCT application.

* cited by examiner

A.

B.

A.

B.

BASIC ANTENNA, AND CORRESPONDING ONE- OR TWO-DIMENSIONAL ARRAY ANTENNA

BACKGROUND OF THE INVENTION

Field of the Invention

The present invention relates to the field of transmitting or receiving antennas as radiating elements that can reach significant directivity levels at frequencies in the vicinity of one or several GHz.

The invention also relates to a one- or two-dimensional array antenna with a permanent or reconfigurable beam formation including a plurality of basic antennas according to the invention positioned on a surface.

Basic antennas of the EBG (Electromagnetic Band Gap) type, each having a structure designed on the principle of Electromagnetic Band Materials and each having a radiation diagram capable of forming a spot close to a disc on a lighted surface, are traditionally used as radiating elements of a more complex antenna.

Description of the Related Art

International patent application WO 01/37373 describes several embodiments of this type of basic antenna. According to this document, a basic antenna of the EBG type traditionally comprises a probe capable of converting electricity into electromagnetic energy and vice versa, and an assembly of elements made from at least two materials differing by their permittivity and/or their permeability and/or their conductivity within which the probe is positioned. This assembly traditionally includes a structure designed based on the principle of Electromagnetic Band Gap (EBG) materials. This structuring makes it possible to improve the directivity of the basic antenna, by ensuring the radiation of the basic antenna as well as spatial and frequency filtering of the electromagnetic waves produced or received by the basic antenna.

However, when they are assembled and juxtaposed in an array antenna, the basic antennas of the EBG type have significant coupling. This strong coupling creates harmful and disruptive interactions between the basic antennas, due to the capture and uncontrolled redistribution by each probe of the energy emitted by the neighboring probes. This results in radiation diagrams of the corresponding array antenna that are generally chaotic and not very directive. Furthermore, the basic radiating surfaces generated by each source are superimposed on one another and form a non-uniform surface that is not very acceptable for agility.

The invention aims to propose a basic antenna of the EBG type with high directivity capable of generating a radiating surface with a predefined shape whereof the coupling with the neighboring antenna of the same type is improved, i.e., a basic antenna that disrupts and is disrupted little by surrounding basic antennas with an identical structure, and the generated radiating surface of which is quite limited, thereby avoiding overlapping of the radiating surfaces with each other.

To that end, the invention relates to a basic antenna designed to form an element of an array antenna comprising:

- a probe capable of converting electricity into electromagnetic energy and vice versa;
- a planar electromagnetic wave reflector bearing the probe; and
- an assembly of elements made from at least two materials differing by their permittivity and/or their permeability and/or their conductivity, the assembly including:

- a structure configured based on the principle of Electromagnetic Band Gap materials and having a periodicity in the direction orthogonal to the planar reflector; and
  - a cavity in contact with the planar reflector and the structure;

the probe being contained in the plane of the reflector in contact with the cavity or in the cavity in contact with the planar reflector, the cavity constituting a defect in the periodicity of the structure giving the assembly the behavior of an Electromagnetic Band Gap material with a defect, in which the positioning of the elements in said assembly ensures the radiation and a spatial and frequency filtering of the electromagnetic waves produced or received by the probe, said filtering in particular allowing one or more operating frequencies of the basic antenna inside a frequency band gap;

said basic antenna being characterized in that it comprises a wall enclosure capable of reflecting the electromagnetic waves at the operating frequency or frequencies, said wall enclosure being an extension in the direction orthogonal to the planar reflector and simultaneously surrounding only the probe, the cavity and the structure, making it possible to generate a basic radiating surface with a predetermined shape and imposed by the wall enclosure.

On the upper surface of the device, this wall enclosure creates a radiating surface with a shape predefined by its contour, while the traditional EBG basic antennas with no wall enclosure generate radiating surfaces with a circular geometry larger than the physical opening.

According to other features considered alone or in combination:

- the wall enclosure has a transverse section whereof the inner contour is fitted in a circle and whereof the ratio of the surface area contained in the circle to the surface area contained in the inner contour is comprised between 1 and 5;
- the wall enclosure has a transverse section whereof the outer contour is a regular polygon preferably having three or four sides;
- the wall enclosure has a transverse section whereof the outer contour is a first regular polygon and whereof the inner contour is a second regular polygon, the second polygon being homothetic with the first polygon, the first and second polygons being concentric and preferably having three or four sides;
- the probe is comprised in the set made up of strip antennas, dipoles, circular polarization antennas, slots and coplanar wire-plate antennas; and
- the probe is a strip antenna, and the wall enclosure includes four metal walls that delimit a rhomb having a height along the axis orthogonal to the planar reflector and a transverse section relative to that same axis with a square shape, the height, length, respectively, of one side of the square being substantially equal to one time, respectively half of, the/the wavelength associated with the operating frequency of the basic antenna.

The invention also relates to a one- or two-dimensional array antenna including a plurality of joined basic antennas, defined above and arranged relative to one another to compactly cover, in a single piece, one or more planar support surfaces, thereby generating pixelated radiating surfaces responsible for several radiation lobes. A radiating surface is therefore generated, on which electromagnetic fields are responsible for the desired radiation under the principle of radiating equivalence of a radiating opening, known by those skilled in the art.

According to other features considered alone or in combination:

the total number of basic antennas making up the plurality is equal to a number of rows N multiplied by a number of columns M, and the basic antennas are arranged relative to one another to compactly cover a rectangle of a planar support surface so as to form a rectangular matrix of N·M basic antennas with N rows and M columns, and the wall enclosures across from any two neighboring basic antennas are in contact;

the one- or two-dimensional array antenna further includes:

power distributing means;

supply means for the plurality of basic antennas in amplitude and phase, said supply means being connected at their input to the power distributing means, and connected at their output to said plurality of basic antennas by switches that can be controlled to selectively power or extinguish each basic antenna; and the power supply means include phase shift means and/or amplification means.

The invention will be better understood upon reading the following description, provided solely as an example and done in reference to the appended drawings, in which.

BRIEF SUMMARY OF THE INVENTION

Figure 1:
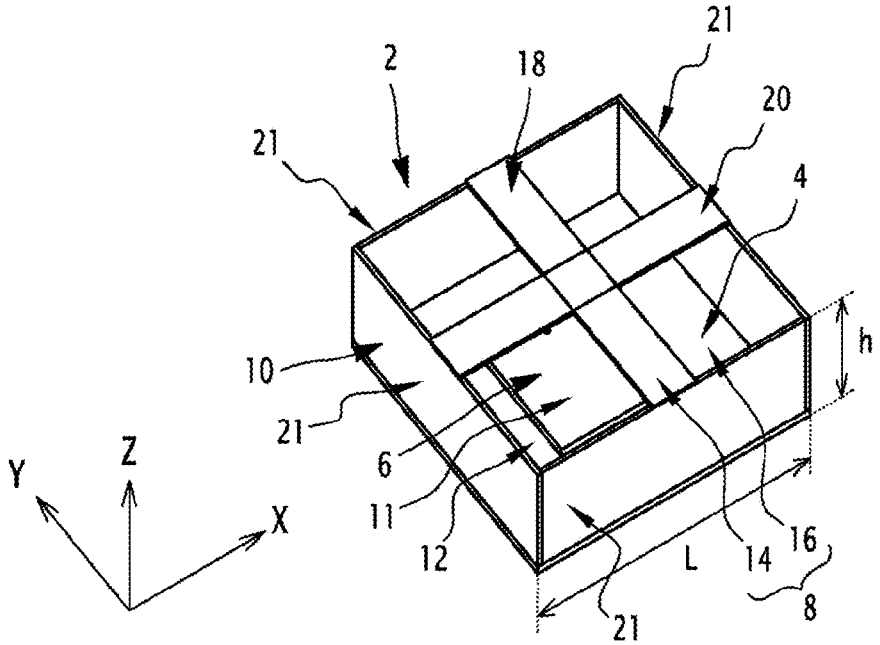
FIG. 1 is a three-dimensional view of a single example embodiment of a basic antenna according to the invention.

According to FIG. 1, a basic antenna 2, designed to form a radiating element of an array antenna, comprises a planar electromagnetic wave reflector 4, a probe 6 capable of converting electricity into electromagnetic energy and vice versa, an assembly 8 of elements made from at least two materials differing by their permittivity and/or their permeability and/or their conductivity, and a wall enclosure 10 capable of reflecting electromagnetic waves at the operating frequency or frequencies of the basic antenna 2.

The planar reflector 4 is a metal plane bearing the probe 6.

The probe 6 is an antenna patch including a square metal plate 11, and a square dielectric substrate 12 on which the metal plate 11 is printed and which separates the metal plate 11 from the planar reflector 4.

The length of one side of the metal plate 11 is equal to half of the wavelength $\lambda_0$ associated with a predetermined operating frequency of the basic antenna 2, while the length, denoted L, of one side of the dielectric substrate 12 is substantially equal to the wavelength $\lambda_0$ associated with the operating frequency of the basic antenna 2.

The assembly 8 comprises a structure 14, configured on the principle of so-called Electromagnetic Band Gap (EBG) materials and having a periodicity in the direction orthogonal to the planar reflector 4, and a cavity 16 here formed by air or vacuum and separating the structure 14 from the probe 6.

The structure 14 includes alternating planar layers made from two materials, for example alumina and air, respectively, differing by their permittivity and/or their permeability and/or their conductivity.

The structure 14 comprises two strips 18, 20 of EBG materials with same dimensions, forming a planar cross positioned across from the probe 6 through the air cavity 16 at a height designated by h of the reflective plane 4. Each strip has a length equal to the length L of the side of the dielectric substrate 12 and a width smaller than the length of one side of the metal plate 11.

The height h here is substantially equal to half of the wavelength associated with the operating frequency of the basic antenna 2, i.e., $\lambda_0/2$.

Here, the ratio of the height h to the thickness of the structure 14 is greater than 5.

The wall enclosure 10 includes four metal walls 21 that simultaneously surround the probe 6, the cavity 16, and the structure 14 comprising the two strips 18 and 20. The four metal walls 21 delimit a rhomb that has a vertical extension with height h along the axis Z orthogonal to the planar reflector 2, on the one hand, and a transverse section relative to that same axis Z with a square shape, on the other hand. The side of the square forming the transverse section with extension XY has the same length L as the side of the square forming the dielectric substrate 12.

The cavity 16 constitutes a defect in the periodicity of the structure 14 and thus gives the assembly 8 the behavior of a EBG material with a defect in which the arrangement of the elements in said assembly 8 ensures the radiation and a spatial and frequency filtering of the electromagnetic waves produced or received by the probe 6.

The filtering in particular allows one or more operating frequencies of the basic antenna 2 inside a frequency band gap.

The assembly 8 thus allows the basic antenna 2 to authorize several frequency propagation modes inside a band gap, in one or more authorized spatial directions, the spatial filtering itself depending on the frequency and nature of the materials included by the assembly 8.

The presence of the wall enclosure 10 makes it possible to significantly decrease the coupling between the probes 6 of two basic antennas 2 that are juxtaposed and in contact with one another by their shared metal walls 21.

In an array antenna incorporating such juxtaposed basic antennas 2 as radiating elements, the basic antennas 2 not disrupting one another, a lower number of basic antennas 2 will be necessary to achieve the same directivity as an array antenna using EBG antennas with no reflective wall enclosure.

Furthermore, the wall enclosure 10 allows the basic antenna 2 to generate a radiating spot with the appropriate shape and distribution into fields.

The materials making up the assembly 8 are preferably materials with low losses, for example plastic, ceramic, ferrite or metal.

In general, the cavity 16 may be:

- a local modification of dielectric and/or magnetic and/or conductivity characteristics of the materials used;
- a local modification of the dimensions of one or more materials.

In general, a basic antenna comprises a probe capable of transforming electricity into electromagnetic energy and vice versa, a planar electromagnetic wave reflector bearing the probe, an assembly of elements made from at least two materials differing by their permittivity and/or their permeability and/or their conductivity.

The assembly includes a structure configured using the principle of Electromagnetic Band Gap materials and having a periodicity in the direction orthogonal to the planar reflector, and a cavity in contact with the planar reflector and the structure.

The probe is contained in the plane of the reflector in contact with the cavity or in the cavity in contact with the planar reflector, the cavity constituting a defect in the periodicity of the structure giving the assembly the behavior of an EBG material with a defect in which the positioning of the elements in said assembly ensures the radiation and a spatial and frequency filtering of the electromagnetic waves produced or received by the probe, that filtering in particular authorizing one or more operating frequencies of the basic antenna inside a frequency band gap.

The basic antenna comprises a wall enclosure capable of reflecting the electromagnetic waves at the operating frequency or frequencies, the wall enclosure being an extension in the direction orthogonal to the planar reflector and simultaneously surrounding only the probe, the cavity and the structure, making it possible to generate a basic radiating surface with a predetermined shape imposed by the wall enclosure.

Generally, the probe of the basic antenna is comprised in the set made up of strip or plate antennas, dipoles, circular polarization antennas, slots and coplanar wire-plate antennas.

In general, the probe is contained in the plane of the reflector in contact with the cavity or in the cavity in contact with the planar reflector.

In general, the wall enclosure has a transverse section whereof the inner contour fits in a circle and whereof the ratio of the surface area contained in the circle to the area of the surface contained in the inner contour is comprised between 1 and 5.

Preferably, the wall enclosure has a transverse section whereof the outer contour is a regular polygon preferably having three or four sides.

Preferably, the wall enclosure has a transverse section whereof the outer contour is a first regular polygon and whereof the inner contour is the second regular polygon, the second polygon being homothetic with the first polygon, the first and second polygons being concentric and preferably having three or four sides.

Figure 2:
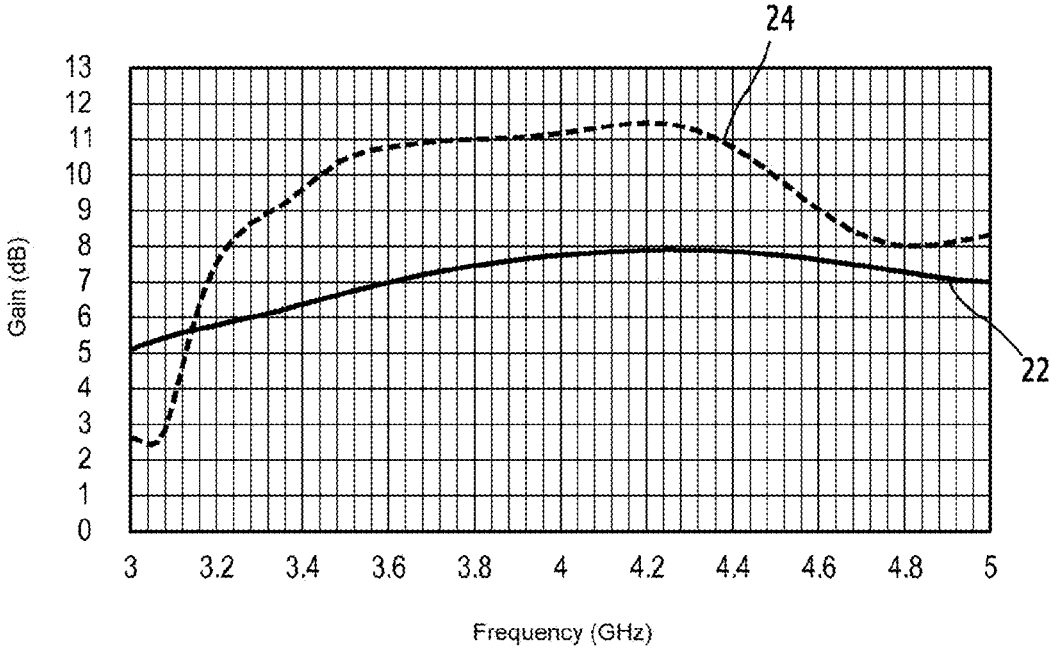
FIG. 2 is a tracing of the evolution curves of the gain as a function of frequency, for a basic antenna of the state of the art and for a basic antenna of FIG. 1, respectively.

In FIG. 2, curves 22, 24 respectively show the evolution of the gain as a function of the frequency for a traditional patch-type antenna and for the basic antenna of FIG. 1.

The gain being proportional to the directivity, curves 22 and 24 clearly show that the directivity of the basic antenna 2 is considerably improved relative to the directivity of a traditional patch antenna for comparable dimensions.

Indeed, along the curve 22, the basic patch antenna of the state of the art has a maximum gain of 8 dBi, while the basic antenna 2 according to the invention has a maximum gain of 11.5 dBi on curve 24.

The basic antenna 2 according to the invention therefore has significantly higher performance levels, in terms of gain and directivity, than a traditional patch antenna of the state of the art.

Figure 3:
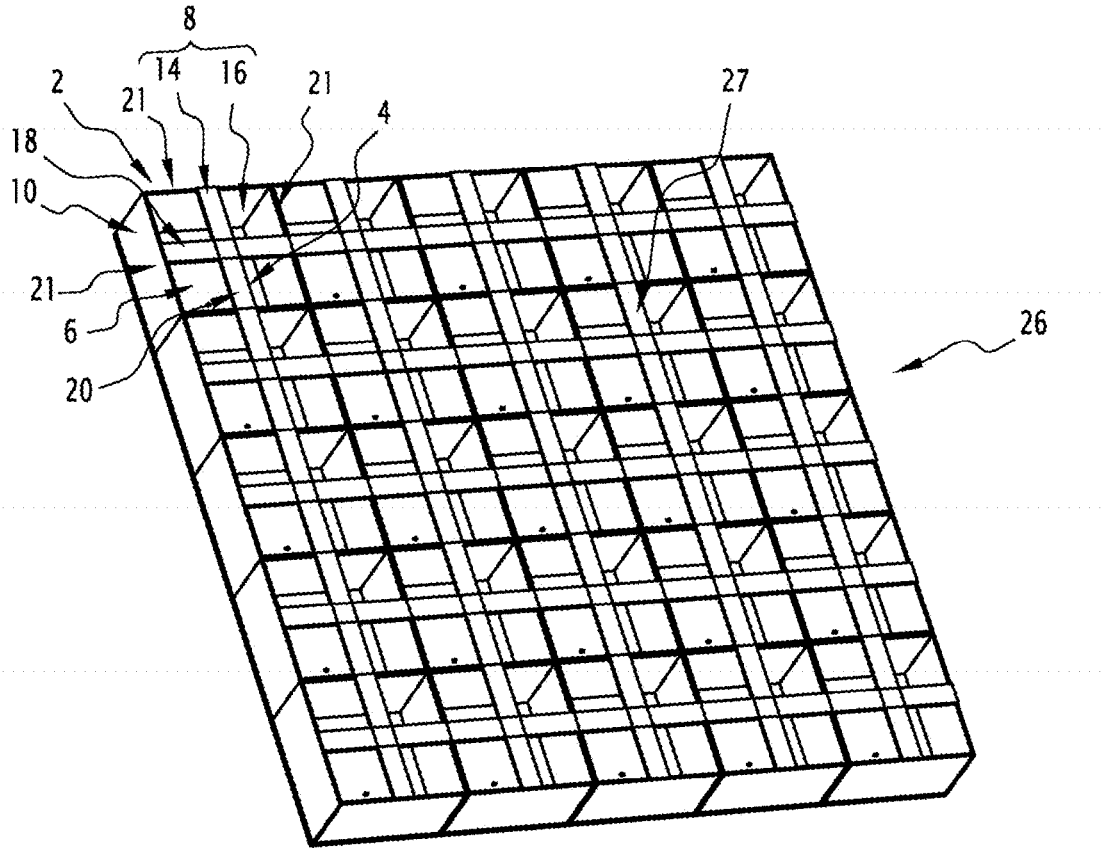
FIG. 3 is a partial three-dimensional view of an array antenna according to the invention including array antennas described in FIG. 1.

In FIG. 3, a two-dimensional array antenna 26 is made up of a plurality 27 of basic antennas 2 identical to those of FIG. 1 and positioned on a planar surface.

In this particular embodiment, the two-dimensional array antenna 26 includes 5 rows and 5 columns, or a total number of basic antennas 2 equal to 25.

The basic antennas 2 of the plurality 27 are here therefore EBG antennas with defect that each include a planar reflector 4, a plate or strip probe 6, an EBG assembly 8 with a cavity 16, and a wall enclosure 10 made up of four metal walls 21 surrounding both the probe 6 and the assembly 8.

In no case is the embodiment of the two-dimensional array antenna 26 limiting with respect to that described in FIG. 3, other embodiments of the two-dimensional array antenna 26 being able to be considered in terms of alternatives of the basic antennas 2, or in terms of number of radiating elements and their arrangement.

Generally, the basic antennas 2 of the plurality 27 making up the two-dimensional array antenna 26 are arranged relative to one another to compactly cover, in a single piece, one or more planar support surfaces, thereby generating pixelated radiating surfaces responsible for several radiation lobes.

Particularly, the total number of basic antennas 2 comprised by the two-dimensional array antenna 26 is equal to a number of rows N multiplied by a number of columns M. In the two-dimensional array antenna 26, the basic antennas 2 are arranged relative to one another to compactly cover a rectangle of a planar support surface so as to form a rectangular matrix of N·M basic antennas with N rows and M columns, in which the wall enclosures 10 across from any two neighboring basic antennas 2 are in contact.

Figure 4:
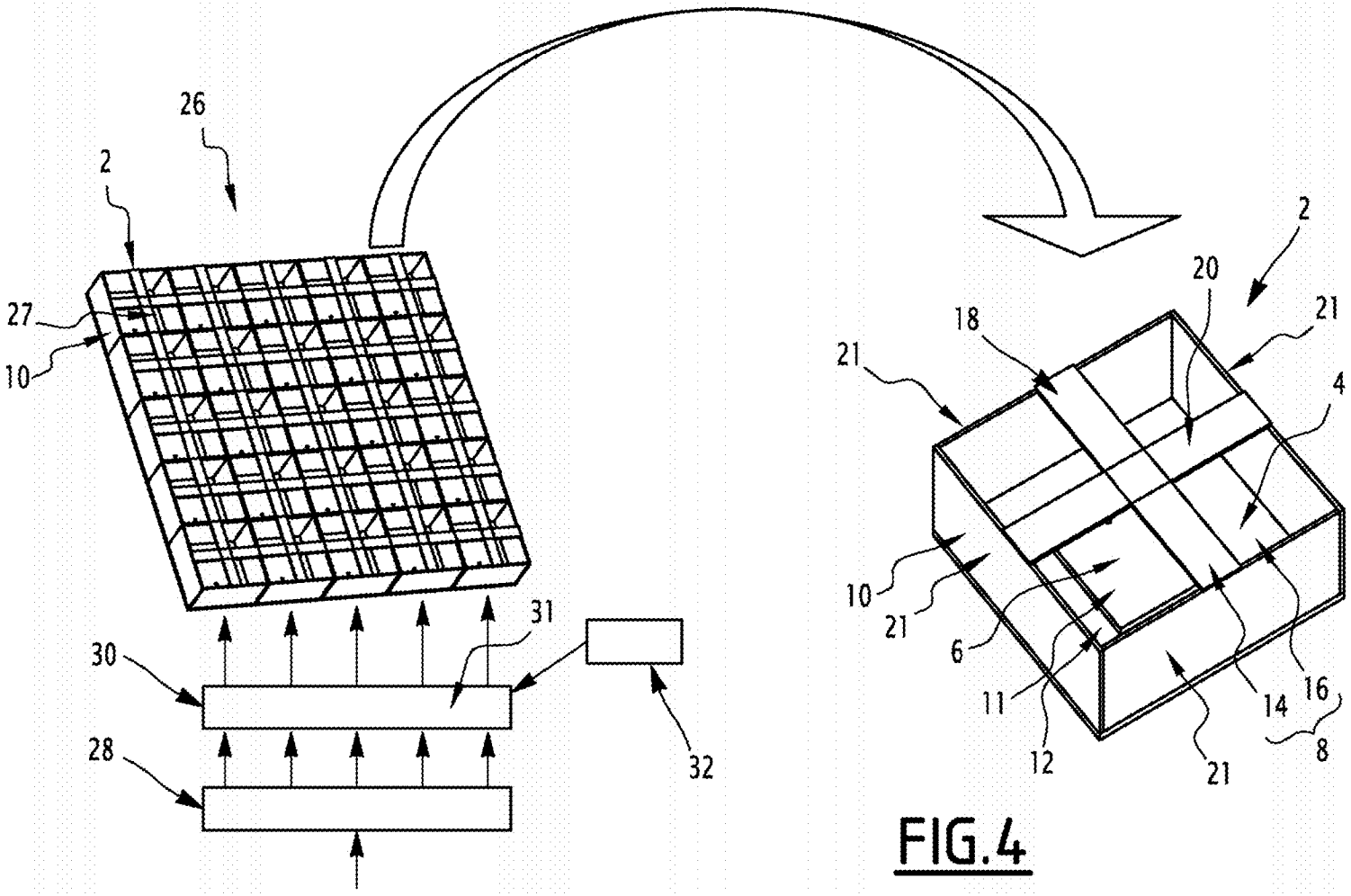
FIG. 4 is a more complete overall diagram of the array antenna of FIG. 3 according to the invention.

In FIG. 4, the two-dimensional array antenna 26 includes power distribution means, globally designated by reference 28, and means for powering the plurality 27 of basic antennas 2, globally designated by reference 30.

In general, the power supply means 30 are connected at their input to the power distributing means 28, and connected at their output to the plurality of basic antennas 2 by controllable switches 31, to selectively power or extinguish each basic antenna 2.

Each controllable switch 31 is connected to a different unique basic antenna 2. Thus in the embodiment shown in FIGS. 3 and 4, the two-dimensional array antenna 26 comprises, upstream from the planar basic antenna surface 2, 25 controllable switches 31, connected to 25 basic antennas 2.

Figure 5:
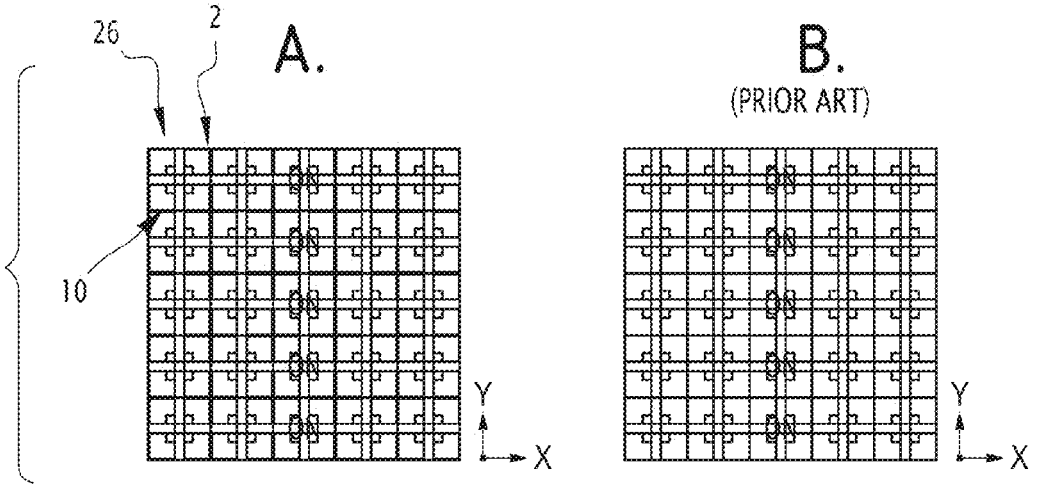
FIG. 5A is a top view of the array antenna of FIGS. 3 and 4.
FIG. 5B is a top view of a traditional array antenna of the state of the art.

The two-dimensional array antenna 26 also comprises control means for the controllable switches 31, globally designated by reference 32 in FIG. 5.

Thus, the selective and controllable power supply of the basic antennas 2 makes it possible to obtain a two-dimensional array antenna 26 that is agile and has a permanent or reconfigurable beam formation, having a radiation diagram with a formed main lobe.

The use of simple switches, made possible owing to the wireless performance of the basic antennas, decreases the complexity of the control and programming means for a configuration of the array antenna.

Alternatively, the power supply means 30 also include phase shifter means and/or amplification means.

These phase shifter and/or amplification means make it possible to obtain a two-dimensional array antenna 26 having an optimal phase and amplitude distribution.

Furthermore, these phase shifter and/or amplification means make it possible to improve the quality of the radiation diagrams, said radiation diagrams having reduced secondary lobes as well as a refined main lobe.

Thus, the two-dimensional array antenna according to the invention has the advantages of being reconfigurable and of having a limited number of elements, and therefore a less complex structure relative to the existing array antennas.

FIGS. 5A and 5B respectively show top views of a two-dimensional array antenna 26 according to the invention, and of a two-dimensional array antenna according to the state of the art comprising basic antennas each without enclosure walls.

On these two-dimensional array antennas, only the basic antennas 2 situated on a central line are powered. In FIGS. 5A and 5B, these powered basic antennas are shown with the note "ON".

Figure 6:
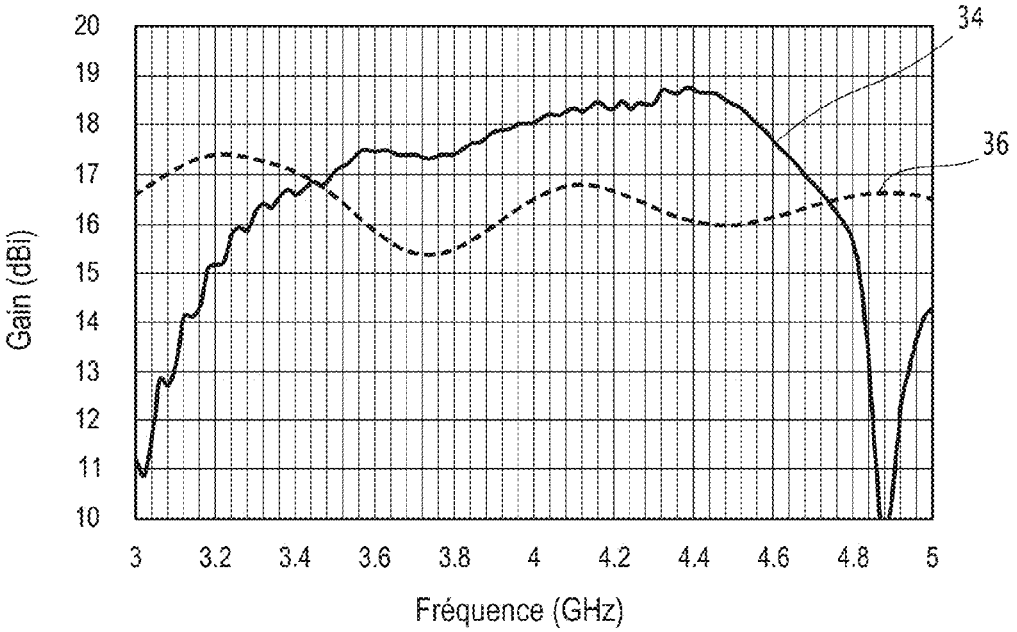
FIG. 6 is a tracing of the evolution curves of the gain as a function of frequency, for an array antenna of the state of the art and for an array antenna of FIGS. 3 and 4, respectively.

In FIG. 6, curves 34 and 36 respectively show the evolution of the gain of the two-dimensional array antennas shown in FIGS. 5A and 5B, as a function of the frequency.

Curve 34 shows the gain of the two-dimensional array antenna 26 according to the invention shown in FIG. 5A and made up of basic antennas 2 having wall enclosures 10, and curve 36 shows the gain of the two-dimensional array antenna shown in FIG. 5B and made up of basic antennas of the state of the art without wall enclosures.

The gain being proportional to the directivity, these curves clearly show that the directivity is noticeably improved with the two-dimensional array antenna 26 according to the invention, relative to the two-dimensional array antenna of the state of the art. In fact, on curve 36, the two-dimensional array antenna of the state of the art has a maximum gain of 17 dBi, while according to curve 34, the two-dimensional array antenna 26 according to the invention achieves a maximum gain of 18.8 dBi.

Figure 7:
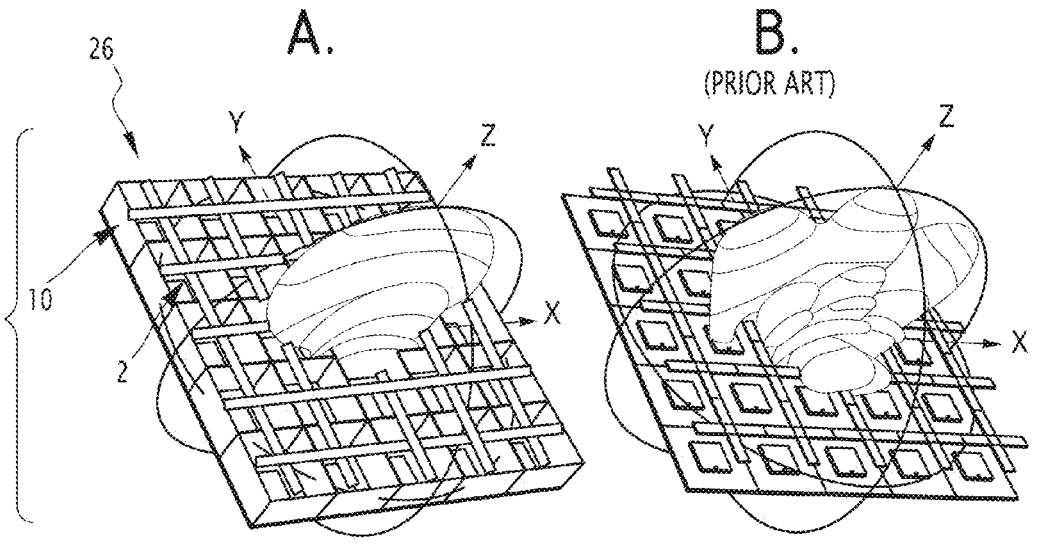
FIG. 7A is a radiation diagram of the array antenna of FIGS. 3 and 4.
FIG. 7B is a radiation diagram of an array antenna of the state of the art.

FIGS. 7A and 7B respectively show the radiation diagrams of a two-dimensional array antenna 26 according to the invention and a two-dimensional array antenna of the state of the art. FIG. 7B shows that the radiation diagram of the two-dimensional array antenna of the state of the art is disrupted and has a plurality of secondary lobes. Conversely, the radiation diagram of the two-dimensional array antenna 26 according to the invention, shown in FIG. 7A, has a strong directivity with reduced secondary lobes.

Thus, the presence of the wall enclosures 10 makes it possible to improve the directivity of the two-dimensional array antenna 26.

Figure 8:
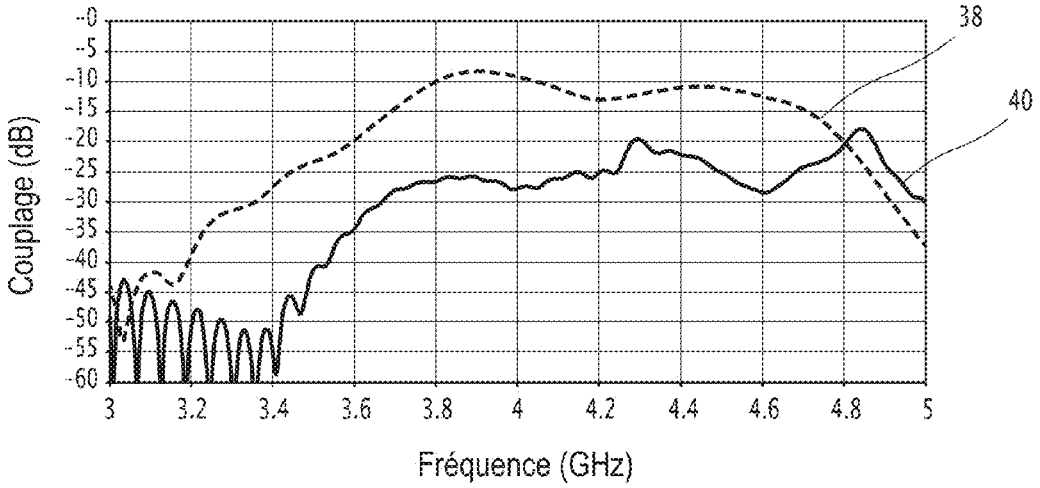
FIG. 8 is a tracing of the evolution curves of the coupling between two adjacent basic antennas as a function of the frequency, for an array antenna of FIG. 3 and an array antenna of the state of the art, respectively.

In FIG. 8, curves 38 and 40 respectively show the evolution of the coupling as a function of frequency, between two basic antennas of the same type and that are juxtaposed.

Curve 38 shows the coupling between two adjacent basic antennas of a two-dimensional array antenna of the state of the art, and curve 40 shows the coupling between two adjacent basic antennas 2 of a two-dimensional array antenna 26 according to the invention.

This FIG. 8 shows that the insertion of the wall enclosures 10 substantially decreases the coupling between the adjacent basic antennas. In fact, along curve 38, the coupling reaches a maximum value substantially equal to −8 dB for the two-dimensional array antenna of the state of the art, whereas on curve 40, the latter assumes a maximum value substantially equal to −20 dB.

It will thus be understood that the basic antenna of the EBG type according to the invention makes it possible to generate a radiation spot with the appropriate shape and distribution into fields, and has a strong directivity and improved coupling with a neighboring antenna of the same type. In fact, the basic antenna according to the invention disrupts and is disrupted little by surrounding basic antennas.

Consequently, in the two-dimensional array antenna according to the invention, a lower number of basic antennas will be needed to reach a same level of directivity as an array antenna using EBG basic antennas with no reflective wall enclosure. Thus, the two-dimensional dimensional array antenna according to the invention, which results from the assembly and juxtaposition of basic antennas according to the invention, will comprise a limited number of elements relative to the two-dimensional antennas of the state of the art and will have a less complex and therefore less expensive structure than the existing two-dimensional array antennas.

Figure 9:
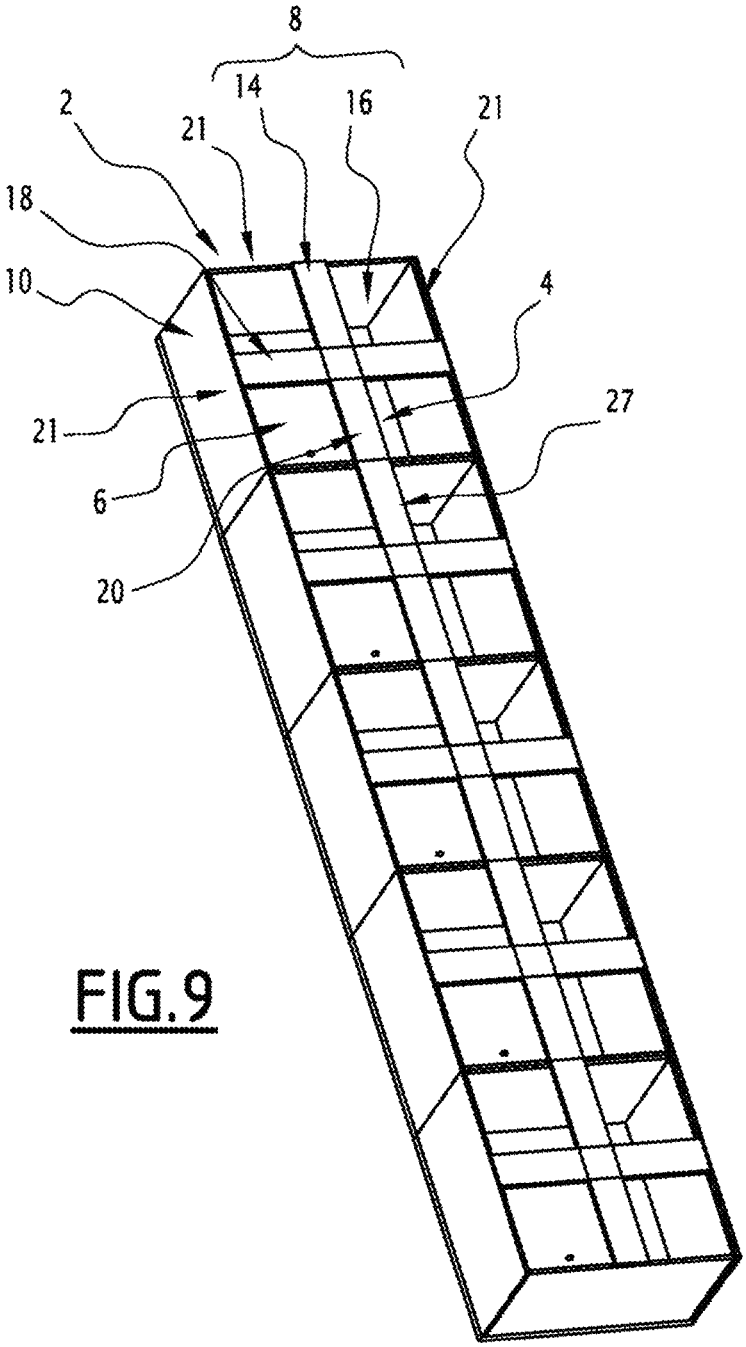
FIG. 9 is a partial three-dimensional view of a one-dimensional array antenna according to the invention including basic antennas according to the invention and described in FIG. 1.

Alternatively, as shown in FIG. 9, the array antenna according to the invention is one-dimensional, i.e., the array antenna for example comprises a plurality of basic antennas aligned in a single direction.

Furthermore, the basic antennas forming the array antenna according to the invention are advantageously joined.

Figure 10:
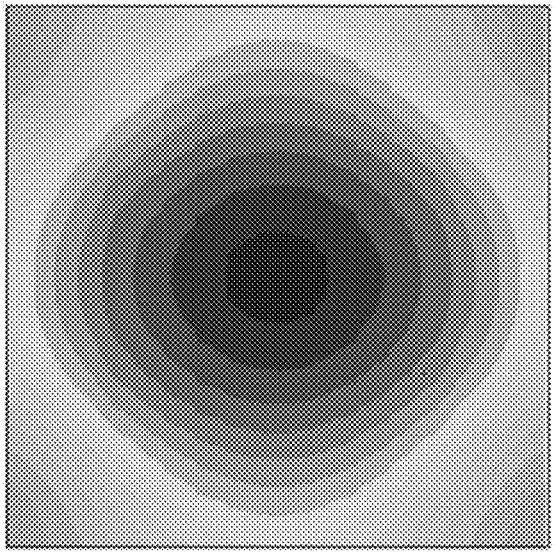
FIG.10 (PRIOR ART)
FIG. 10 is an illustration of the radiating surface generated by a traditional basic antenna of the state of the art.
Figure 11:
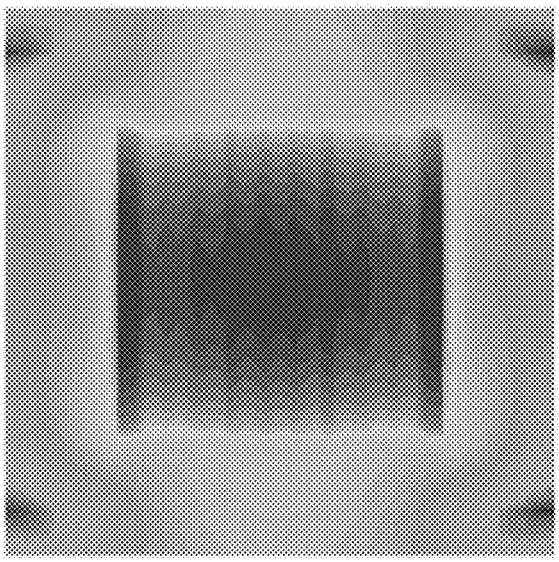
FIG. 11 is an illustration of the radiating surface generated by a basic antenna according to the invention.

FIGS. 10 and 11 respectively show the radiating surface generated by a traditional basic antenna of the state of the art, and the radiating surface generated by a basic antenna according to the invention. These FIGS. 10 and 11 show that on the surface of the basic antenna, the wall enclosure creates a square radiating surface predefined by its contour, contrary to the traditional basic antenna, which does not comprise a wall enclosure and thereby generates a radiating surface with a circular, non-predefined geometry.

These FIGS. 10 and 11 thus show that the basic antenna according to the invention is capable of generating a radiating surface with a predefined shape and a limited shape imposed by the wall enclosure, thereby avoiding overlapping of the radiating surfaces when the basic antennas are juxtaposed.

Figure 12:
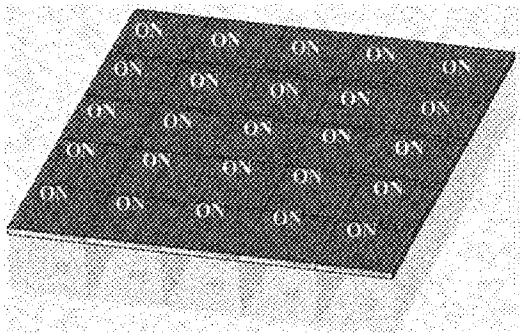
FIG. 12A is a diagrammatic view of an array antenna according to the invention in which all of the basic antennas are powered.
FIG. 12B is an illustration of the corresponding radiating surface synthesized by the array antenna configured according to FIG. 12A.
Figure 12:
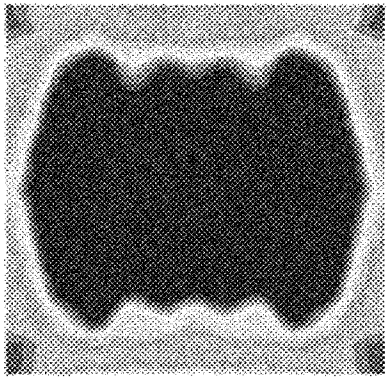

FIGS. 12A and 12B respectively show an array antenna according to the invention in which all of the basic antennas are powered, and the corresponding synthesized radiating surface.

Figure 13:
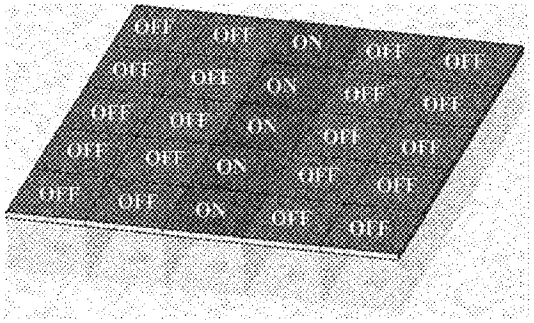
FIG. 13A is a diagrammatic view of an array antenna according to the invention in which only one column of basic antennas is powered.
FIG. 13B is an illustration of the corresponding radiating surface synthesized by the array antenna configured according to FIG. 13A.
Figure 13:
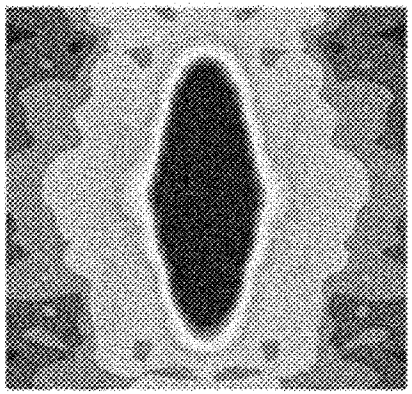

FIGS. 13A and 13B respectively show an array antenna according to the invention in which only one column of basic antennas is powered, and the corresponding synthesized radiating surface.

One can thus see in these figures that the array antenna according to the invention is reconfigurable, i.e., it makes it possible to have agility on the formation of a radiating surface through selective powering of the basic antennas making it up, and thus makes it possible to generate all sorts of pixelated radiating surfaces, by combining basic surfaces generated by each basic antenna.

Figure 14:
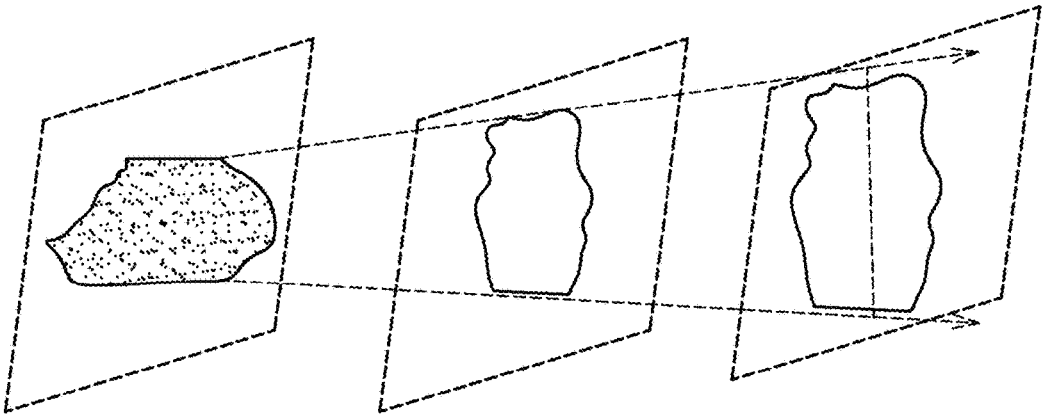
FIG. 14 is a diagrammatic illustration of the operating principle of the array antenna according to the invention.

It should be noted that the name "array antenna" used in the invention corresponds to and traditionally defines an antenna powered by a plurality of sources connected to a feeding network and does not correspond to an antenna array. The operating principle of the array antenna "with pixelated radiating opening" according to the invention consists of generating a radiating surface with any desired shape. Through the theory of radiating openings, this radiating surface creates the radiation diagrams making it possible to ensure a given coverage on land either by simple spatial Fourier transform, or through a double spatial Fourier transform using a reflector. This operation is illustrated in FIG. 14.

Figure 15:
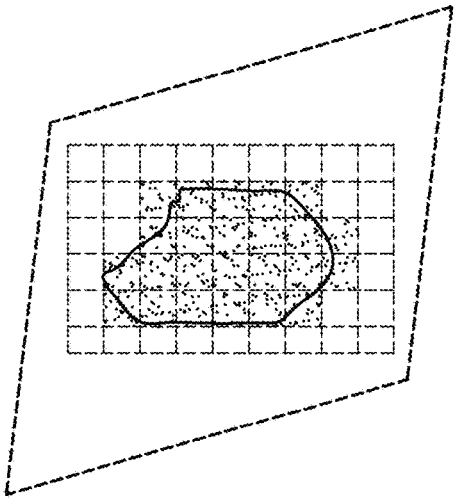
FIG. 15 is a diagrammatic illustration of an array antenna according to the invention configured to generate the desired radiating surface via the combination of pixelated radiating surfaces.

In order to form this radiating surface, the latter is pixelated eyes in a first step and, in a second step, the array antenna made up of several basic antennas is commanded such that each basic antenna corresponding to a pixel of the radiating surface generates part of the radiating surface, as shown in FIG. 15. Thus, a good approximation of the radiating surface is done by the combination of basic surfaces generated by each basic antenna corresponding to a pixel.

Lastly, to have agility for the formation of the radiating surface and generate all outputs thereof, it is very advantageous to have an array antenna made up of basic antennas (pixels) whereof the ON (powered on) or OFF (charged over 50 ohms) states make it possible to have a good approximation of the desired radiating surface. The configuration of the antenna is shown in FIG. 15.

Alternatively, the array antenna comprises, in a single piece, several distinct planar support surfaces with different orientations, on each of which an associated set of basic antennas is positioned, thereby generating different pixelated radiating surfaces responsible for several radiation lobes with different orientations.

Figure 16:
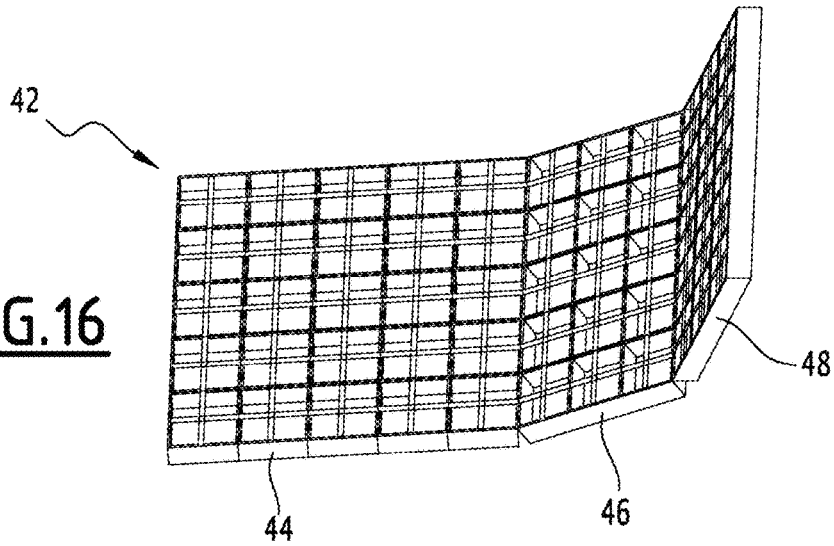
FIG. 16 is a diagrammatic view of a two-dimensional array antenna according to the invention comprising a plurality of basic antennas according to the invention covering three distinct planar support surfaces.

In the example shown in FIG. 16, the array antenna 42 comprises a plurality of basic antennas arranged relative to one another in order to compactly cover, in a single piece, three planar support surfaces 44, 46, 48. In the example shown in FIG. 16, the three planar support surfaces 44, 46, 48 each define a different normal direction.

The invention claimed is:

1. A basic antenna designed to form a radiating element of an array antenna comprising:

a probe for converting electricity into electromagnetic energy and electromagnetic energy into electricity;

a planar electromagnetic wave reflector bearing the probe; and an assembly comprising a structure and a cavity, the cavity being an air cavity in contact with the planar reflector, the structure comprising two strips with same dimensions, made of Electromagnetic Band Gap materials having a periodicity in the direction orthogonal to the planar reflector, forming a planar cross positioned across from the probe through the cavity; and the probe being contained in the plane of the reflector in contact with the cavity or in the cavity in contact with the planar reflector, the cavity constituting a defect in the periodicity of the structure that imparts the assembly with a behavior of the Electromagnetic Band Gap material with a defect in which the positioning of the elements in said assembly ensures the radiation and a spatial and frequency filtering of electromagnetic waves produced or received by the probe, said filtering allowing one or more operating frequencies of the basic antenna inside a frequency band gap;

wherein said basic antenna comprises a wall enclosure capable of reflecting the electromagnetic waves at the operating frequency or frequencies, the wall enclosure including four metal walls that delimit a rhomb having a height along the axis orthogonal to the planar reflector and a transverse section relative to that same axis with a square shape, said wall enclosure surrounding simultaneously and only the probe, the cavity and the structure, making it possible to generate a basic radiating surface with a shape predetermined and imposed by the wall enclosure, the height of the wall enclosure and of the cavity being substantially equal to half of the wavelength associated with the operating frequency of the basic antenna, and a length of one side of the wall enclosure and of each strip of the structure being substantially equal to the wavelength associated with the operating frequency of the basic antenna.

2. The basic antenna according to claim 1, wherein the wall enclosure has a transverse section whereof an inner contour is fitted in a circle and whereof a ratio of the surface area contained in the circle to the surface area contained in the inner contour is comprised between 1 and 5.

3. The basic antenna according to claim 1, wherein the wall enclosure has a transverse section whereof an outer contour is a regular polygon.

4. The basic antenna according to claim 1, wherein the wall enclosure has a transverse section whereof an outer contour is a first regular polygon and whereof an inner contour is a second regular polygon, the second polygon being homothetic with the first polygon, the first and second polygons being concentric and preferably having three or four sides.

5. The basic antenna according to claim 1, wherein the probe is comprised in the set made up of strip antennas, dipoles, circular polarization antennas, slots and coplanar wire-plate antennas.

6. The basic antenna according to claim 1, wherein the probe is a strip antenna.

7. A one- or two-dimensional array antenna including a plurality of adjacent basic antennas, defined according to claim 6, and arranged relative to one another to compactly cover, in a single piece, one or more planar support surfaces, thereby generating pixelated radiating surfaces responsible for several radiation lobes.

8. The one- or two-dimensional array antenna according to claim 7, wherein the total number of basic antennas is equal to a number of rows N multiplied by a number of columns M, and the basic antennas are arranged relative to one another to compactly cover a rectangle of a planar support surface so as to form a rectangular matrix of N·M basic antennas with N rows and M columns, and the wall enclosures across from any two neighboring basic antennas are in contact.

9. The one- or two-dimensional array antenna, according to claim 7, further including:

power distributing means;

supply means for the plurality of basic antennas, said supply means being connected at their input to the power distributing means, and connected at their output to said plurality of basic antennas by switches that can be controlled to selectively power or extinguish each basic antenna.

10. The one- or two-dimensional antenna according to claim 9, wherein the power supply means include phase shifter means and/or amplification means.

11. The basic antenna according to claim 2, wherein the wall enclosure has a transverse section whereof an outer contour is a regular polygon.

12. A one- or two-dimensional array antenna including a plurality of adjacent basic antennas, defined according to claim 1, and arranged relative to one another to compactly cover, in a single piece, one or more planar support surfaces, thereby generating pixelated radiating surfaces responsible for several radiation lobes.

13. The one- or two-dimensional array antenna, according to claim 8, further including:

power distributing means;

supply means for the plurality of basic antennas, said supply means being connected at their input to the power distributing means, and connected at their output to said plurality of basic antennas by switches that can be controlled to selectively power or extinguish each basic antenna.

14. A basic antenna designed to form a radiating element of an array antenna, the basic antenna comprising:

a wall enclosure;

a probe that i) converts electricity into electromagnetic energy and ii) converts electromagnetic energy into electricity;

a planar electromagnetic wave reflector bearing the probe; and an assembly comprising a structure and a cavity, the cavity being an air cavity in contact with the planar electromagnetic wave reflector, the structure having a periodicity and comprising two strips with same dimensions, each of the two strips being made of Electromagnetic Band Gap material having a periodicity in a direction orthogonal to the planar electromagnetic wave reflector, the two strips forming a planar cross positioned across from the probe through the air cavity, wherein the probe is contained in one of the group consisting of i) a plane of the reflector in contact with the cavity and ii) the cavity in contact with the planar reflector, the cavity constituting a defect in the periodicity of the structure, the defect imparting the assembly with a behavior of the Electromagnetic Band Gap material with a defect in which the positioning of the elements in said assembly ensures the radiation and a spatial and frequency filtering of electromagnetic waves produced or received by the probe, said filtering allowing at least one operating frequency of the basic antenna inside a frequency band gap;

wherein the wall enclosure reflects the electromagnetic waves at the at least one operating frequency inside the cavity, the wall enclosure including four metal walls that delimit a rhomb having a height along a first axis orthogonal to the planar reflector and a transverse section relative to the first axis with a square shape, said wall enclosure surrounding simultaneously, and only, the probe, the cavity and the structure, providing generation of a basic radiating surface with a shape predetermined and imposed by the wall enclosure, the height of the wall enclosure and of the cavity being substantially equal to half of the wavelength of the at least one operating frequency of the basic antenna, and a length of one side of the wall enclosure and of each strip of the structure being substantially equal to the wavelength of the at least one operating frequency of the basic antenna.

15. The basic antenna of claim 14, wherein the probe is contained in a plane of the reflector in contact with the cavity.

16. The basic antenna of claim 14, wherein the probe is contained in the cavity in contact with the planar reflector.

17. A one-dimensional or two-dimensional array antenna including a plurality of adjacent basic antennas of claim 14, wherein the probe of each basic antenna is a strip antenna, the plural basic antennas are arranged relative to one another to cover, in a single piece, one or more planar support surfaces, thereby generating pixelated radiating surfaces responsible for several radiation lobes.

18. A two-dimensional array antenna including a plurality of adjacent basic antennas of claim 14 in a row and column arrangement with plural of said basic antennas in each row and in each column, with the wall enclosure of each said basic antenna adjacent the wall enclosure of two other said basic antenna, the plural basic antennas being arranged relative to one another to cover, in a single piece, one or more planar support surfaces, thereby generating pixelated radiating surfaces responsible for several radiation lobes, and wherein the probe of each basic antenna is a strip antenna.

* * * * *